United States Patent [19]

Antonius

[11] Patent Number: 4,479,409

[45] Date of Patent: Oct. 30, 1984

[54] OPEN-END RATCHET WRENCH

[76] Inventor: John I. Antonius, 3848 SW. 36th Pl., Portland, Oreg. 97221

[21] Appl. No.: 464,393

[22] Filed: Feb. 7, 1983

[51] Int. Cl.[3] ..... B25B 13/00

[52] U.S. Cl. ..... 81/58.3

[58] Field of Search ..... 81/58.3, 58.2, 121 A, 81/58, 58.4

[56] References Cited

U.S. PATENT DOCUMENTS

| | | | |
|---|---|---|---|
| 894,641 | 7/1908 | Higbee . | |
| 2,636,411 | 4/1953 | Wood . | |
| 2,651,230 | 9/1953 | Waterval | 81/58.3 |
| 2,660,910 | 12/1953 | Sellers . | |
| 2,697,370 | 12/1954 | Brooks | 81/58.3 |
| 2,707,412 | 5/1955 | Brame . | |
| 2,851,914 | 9/1958 | Zeckzer | 81/58.2 |
| 3,175,434 | 3/1965 | Bergquist . | |
| 4,270,417 | 6/1981 | Tesoro | 81/58.3 |

*Primary Examiner*—James L. Jones, Jr.

*Attorney, Agent, or Firm*—Kolisch, Hartwell, Dickinson & Anderson

[57] ABSTRACT

An open-end ratchet wrench including a handle joined to a crescent-shaped head portion. A jaw member is detachably received within the head portion, the jaw member being removed by axial displacement. Spring-biased, indent-detent means resists axial displacement. Ratchet means is interposed between the jaw member and head portion.

8 Claims, 9 Drawing Figures

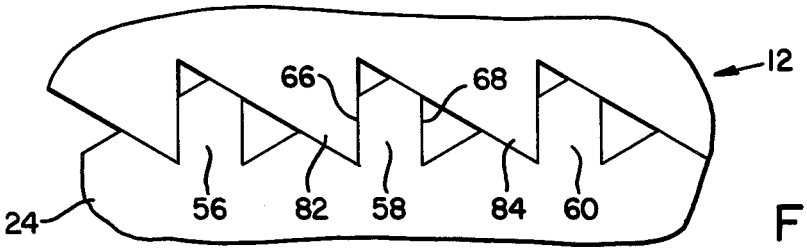
FIG. 5
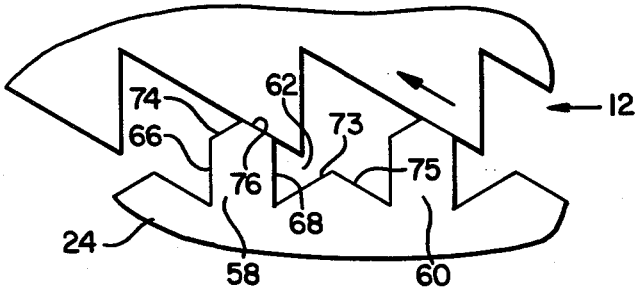
FIG. 6
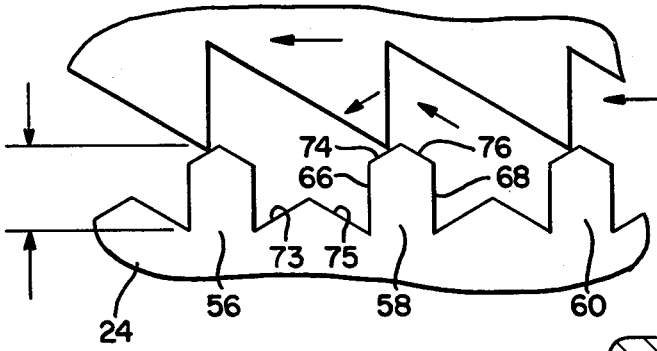
FIG. 7
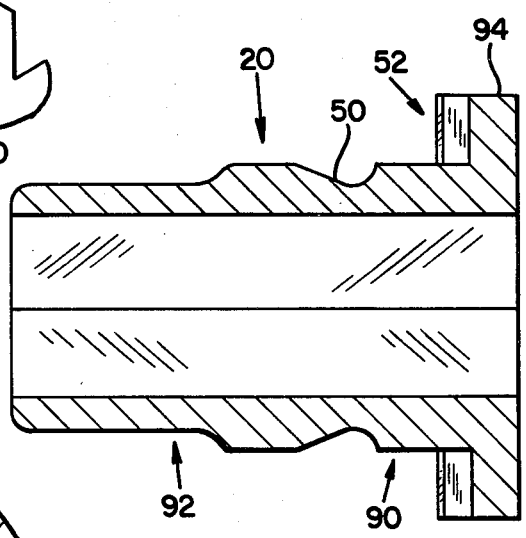
FIG. 8
FIG. 9
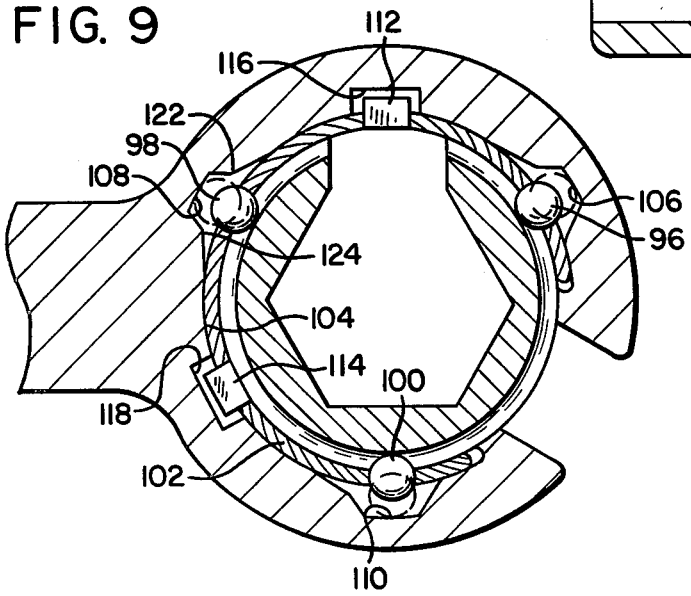

OPEN-END RATCHET WRENCH

BACKGROUND AND SUMMARY

This invention relates to an open-end ratchet wrench.

Ratchet wrenches such as socket-type ratchet wrenches are well known. Ratchet wrenches generally have the obvious advantage of enabling a workman to progressively turn a nut or bolt without having continually to remove and replace the wrench. While open-end ratchet wrenches are known, they have not been widely accepted for a variety of reasons including complexity of construction, bulkiness in construction (which limits their use in confined spaces), and difficulties presented in using the wrench, particularly in the manner in which the operation of the wrench is reversed.

Generally, it is an object of this invention to provide an improved open-end ratchet wrench which substantially obviates problems commonly associated with such wrenches in the past.

More specifically, an object of this invention is to provide such a wrench which is produceable with a relatively compact configuration facilitating use of the wrench in confined spaces.

Another object is to provide such a wrench which is relatively simple in construction. As a corrollary, the wrench is reliable in operation and relatively maintenance-free.

A further object is to provide such a wrench with improved ratchet means producing rotary movement of a ratcheted jaw member in the wrench.

Yet another object is to provide an open-end ratchet wrench which is easily adjusted to produce reverse operation.

Yet a further feature and object of the invention is the provision of such a wrench which includes separable jaw member detachably mounted in a crescent-shaped head portion of the wrench, and a novel organization of indent-detent means which serves detachably to hold the jaw member in place and also functions to bias a ratcheting action in the wrench.

Yet another object is to provide in such a wrench a novel form of spring-biased detent means operating to hold a detachable jaw member in place.

These and various other objects and advantages are attained by the invention which is described hereinbelow in conjunction with the accompanying drawings, wherein:

FIGS. 5, 6 and 7 are enlarged, simplified drawings of ratchet teeth in the wrench illustrating how such operate;

FIG. 8 illustrates a modified form of jaw member, and

FIG. 9 is a cross-sectional view of the head portion in a wrench illustrating yet another modified form of the invention.

A DETAILED DESCRIPTION OF A PREFERRED EMBODIMENT OF THE INVENTION

Figure 1:
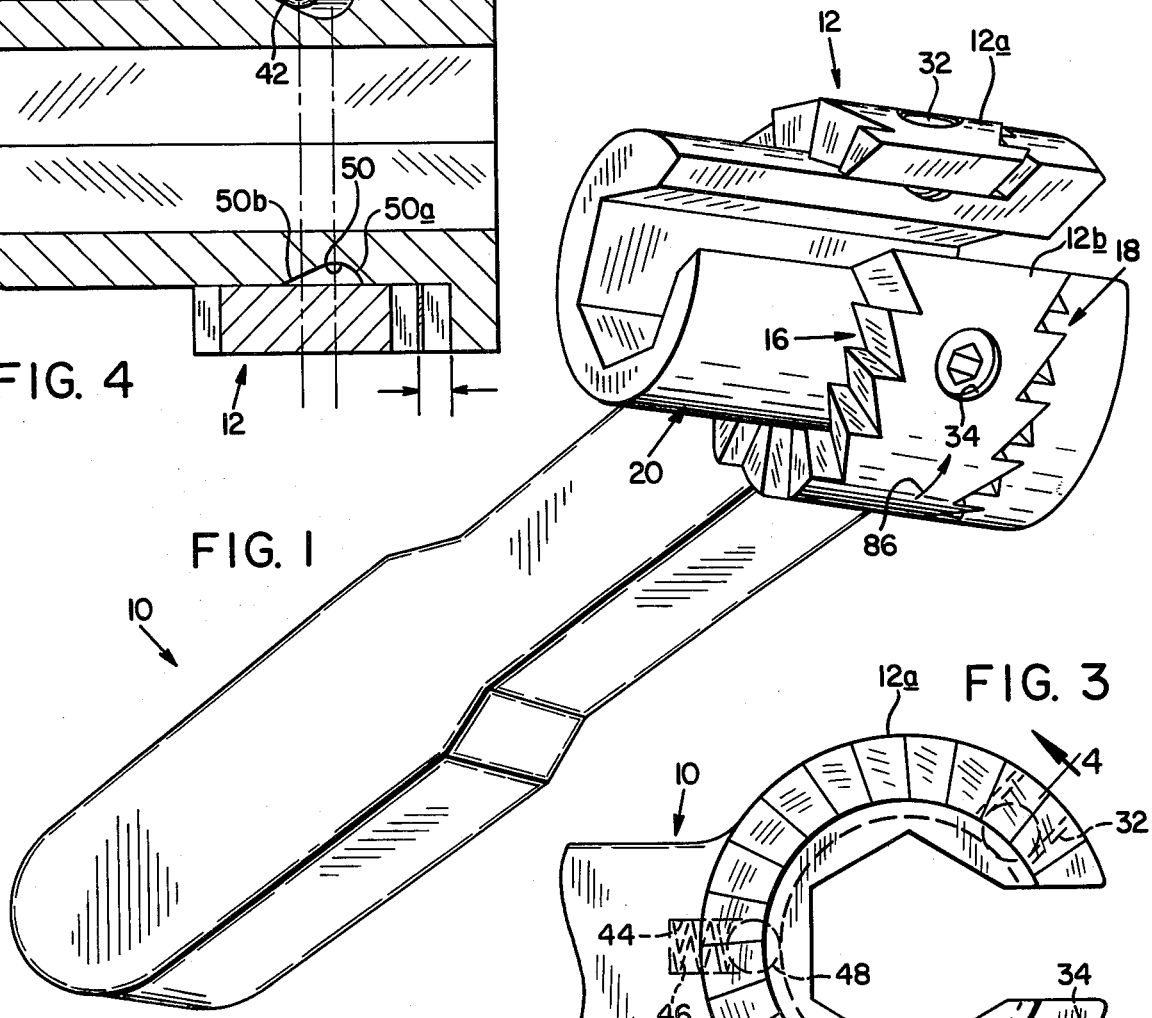
FIG. 1 is a perspective view illustrating the wrench, which includes a handle portion terminating in a crescent-shaped head portion, the head portion detachably mounting a jaw member in the wrench.
Figure 3:
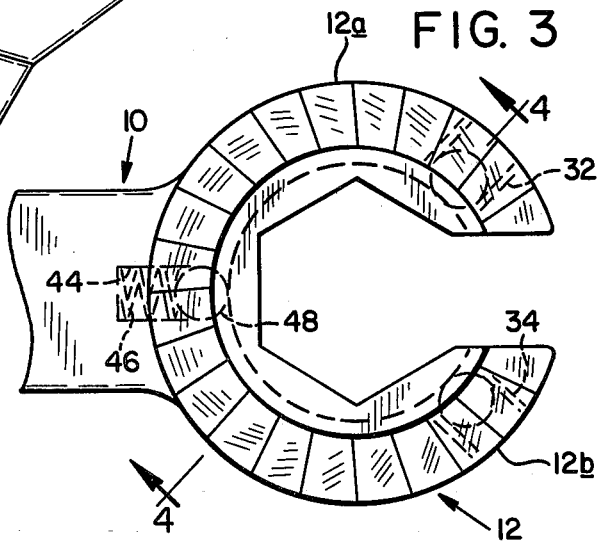
FIG. 3 is a view showing the axial end of the head portion in the wrench.
Figure 2:
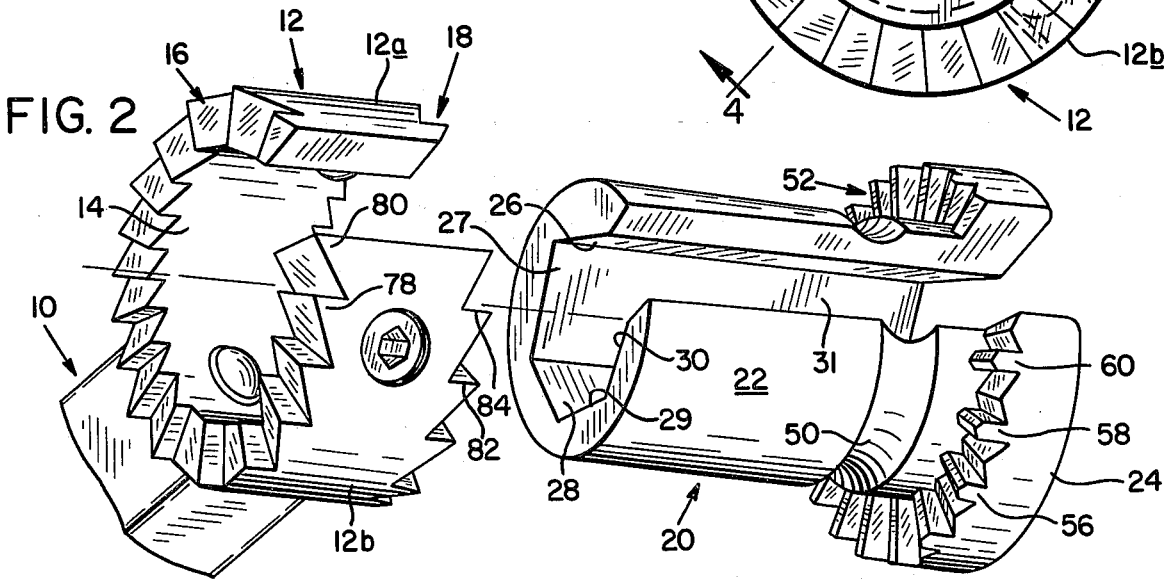
FIG. 2 illustrates the head portion of the wrench with the jaw member detached therefrom.

Referring now to the drawings, and initially more particularly to FIGS. 1 and 2, the wrench illustrated comprises a handle portion indicated at 10 which is integrally joined to a crescent-shaped head portion 12. The handle portion may take any of a number of different forms. The head portion is formed by opposed arms 12*a*, 12*b* terminating in spaced-apart ends, the arms extending incompletely about a cylindrical opening which extends axially in the head portion, such opening being shown in 14. Provided at each of opposite axial ends of the head portion is an annular row of teeth, indicated at 16, 18, respectively.

Detachably mounted in head portion 12 is what is referred to herein as a jaw member 20. Such includes (refer to FIG. 2) an elongate sleeve portion 22, and joined to one end of this sleeve portion, an annular flange portion 24. The sleeve portion of this jaw member is snugly received by opening 14 in the head portion.

The jaw member has an internal, axially extending chamber opening to the ends of the jaw member defined by flat internal wall surfaces indicated at 26, 27, 28, 29 and 30. These wall surfaces are adapted nonrotatably to receive a nut. In the case of the particular jaw member shown, such would be a six-sided nut. Jaw members having differently sized and configured internal chambers are provided for the various common nut sizes with which the wrench is to be used.

The jaw member has a slot 31 extending along one side thereof.

Releasable indent-detent means is provided interposed between the head portion and jaw member which accommodates rotation of the jaw member without release of this means, and axial displacement of the jaw member in opening 14 with release of the indent-detent means. More specifically, adjacent the ends of arms 12*a*, 12*b* are internally threaded bores, 32, 34. Screwed into each is a spring-biased ball assembly 36 including a sleeve retainer 38 (see FIG. 4) externally threaded whereby such may be screwed into an internally threaded bore, such mounting within it a compression spring and ball shown at 40, 42, respectively. The sleeve retainer is, as customary with such an assembly, turned over slightly on its inner end so as to prevent the ball from being expelled from the sleeve retainer.

A third spring-biased ball may be provided in head portion 12 adjacent handle portion 10. In this instance it is convenient to provide a bore, such as bore 44, which has mounted within it a spring such as spring 46, and a ball, such as ball 48. Again, the metal surrounding the bore (after the assembly has been completed) is turned over slightly to prevent expelling of the ball from the bore.

The protruding surfaces of the respective balls constitute spring-biased detent means in the organization.

Figure 4:
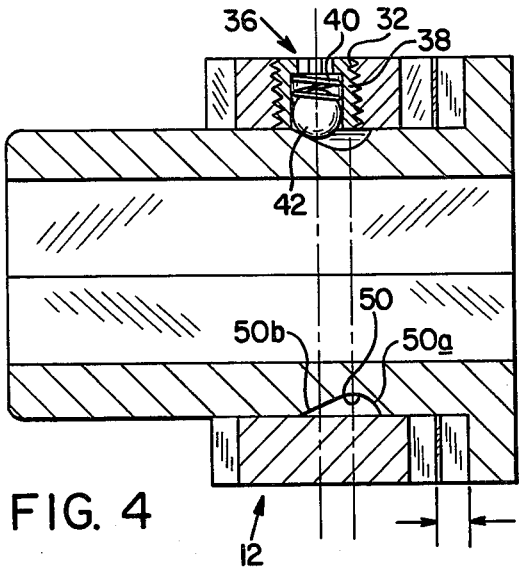
FIG. 4 is a cross-sectional view taken generally along the line 4—4 in FIG. 3.

Sleeve portion 22 of the jaw member is provided around the perimeter thereof with an annular groove 50, which groove constitutes an indent means. The groove preferably has a cross-sectional profile as illustrated in FIG. 4, and includes a deeper portion 50*a* where the various balls fully seat in the groove, and a sloping somewhat shallower portion 50*b* joining with the deeper portion.

Flange portion 24 of the jaw member is provided with an annular row of teeth 52 (see FIG. 2) which project axially of the jaw member. These teeth are shaped so as to be engageable with teeth in the head portion of the wrench, with the teeth of the head portion facing either of opposite directions. This is probably best illustrated in FIG. 2, and FIGS. 5, 6, and 7 (the latter figures showing the ratcheting teeth in the wrench in enlarged views and with the teeth of the rows extending in a plane, rather than in annular course).

More specifically, illustrated at 56, 58 and 60 are three successive teeth in the row of teeth 52. Successive teeth are separated by a gap, as exemplified by gap 62. Each tooth is bounded by side abuttment surfaces, exemplified by surfaces 66, 68. Each tooth is capped by inclined surfaces, such as surfaces 74, 76 that, progressing toward the sides of the tooth, slope into the gap that separates adjacent teeth. The floor of the gap between adjacent teeth is formed by inclined surfaces 73, 75.

The teeth in the head portion of the wrench in rows 16, 18, face in the same direction as can be seen in FIG. 2, which is to say that teeth 78, 80 in row 16 face upwardly as do the teeth on the opposite side, exemplified by teeth 82, 84 in row 18. Thus, with the jaw member inserted into the head portion of the wrench by advancing the jaw member to the left in FIG. 2 (to produce the assembled condition of the parts illustrated in FIG. 1), the teeth in row 18 engage the teeth of the jaw member, and these teeth face a counterclockwise direction as shown by arrow 86 in FIG. 1. If, before insertion of the jaw member, the head portion were to be turned over, the teeth in row 16 would engage the teeth of the jaw member in the wrench, and were the assembled wrench then pictured as in FIG. 1, the teeth engaging the jaw member would be facing in the opposite direction.

Referring to FIGS. 5 and 6, in these figures the teeth of the head portion, exemplified by teeth 82, 84 face to the right. With the teeth fully seated, the teeth engage abuttment surfaces 66 in the respective teeth of the jaw member. Movement of the teeth in the head portion to the right in these figures thus produces corresponding movement in the teeth of the jaw member.

Movement of the teeth in the head portion in the opposite direction, i.e., movement of the teeth in the head portion to the left, if relative axial movement of the jaw member away from the head portion is permitted, is accompanied with the teeth of the head portion climbing outwardly from the gaps between the teeth of the jaw member, and with the back surfaces of the teeth in the head portion sliding on one set of inclined surfaces which cap the teeth of the jaw member, as illustrated in FIG. 6. Continued movement causes the teeth of the head portion to slide downwardly over the other set of inclined surfaces capping the teeth of the jaw member, as illustrated in FIG. 7. Further movement, accompanied with axial movement of the jaw member toward the head portion, results in a fully seated position being reestablished, with each tooth in the head portion now engaging a tooth in the jaw member which is one tooth to the left of the tooth originally engaged.

The axial displacement discussed is accommodated by the indent-detent means provided, as best illustrated in FIG. 4. This illustrates jaw member 20 displaced axially of head portion 12 to the extent necessary to have the teeth in the head portion clear the teeth in the jaw member. The spring-biased balls mounted in the head portion with such movement move into shallow portion **50*b* of groove 50**. The balls do not completely clear the groove, however (as they do when the jaw member is completely removed from the head portion). While accommodating axial displacement of the jaw member relative to the head portion to the extent required to obtain the ratcheting action described, the balls, by reason of being biased radially inwardly and engaging the sloping surface of the groove, resiliently resist such displacement.

FIG. 8 illustrates a modified form of the invention. As illustrated in FIG. 8, jaw member 90 has a sleeve portion 92, whose outer diameter at the end opposite the end having annular flange 94 is reduced from the outer diameter of the sleeve portion where such joins with the flange portion. This permits the wrench to be utilized under circumstances wherein the space around the nut to be tightened is extremely confined.

In the modification of the invention shown in FIG. 9, the balls in the indent-detent means comprise balls 96, 98, 100 interconnected by metallic cable 102. The cable seats within a channel 104 extending about the inside of the head portion. The balls seat within recesses 106, 108 and 110. Blocks 112, 114 secured to cable 102 and loosely fitted within chambers 116, 118, serve to locate the cable within the channel. Considering, for example, ball 98, such is depressible within recess 108 with the cable bending about shoulders 122, 124. The ball is biased radially inwardly by the resilient resistance to bending which the cable offers.

The operation of the open-end wrench should be obvious. Either end of the jaw member may be used in fastening onto the periphery of a nut. To reverse the direction of the ratcheting action, the handle with its head portion is displaced axially from the jaw member to separate the parts, and disengage the teeth in one row of teeth in the head portion from the teeth in the jaw member. The head portion then is turned over, to place teeth in the opposite row of teeth in engagement with the teeth of the jaw member. The slot extending along the length of the jaw member is aligned with the opening between the ends of the arms in the head portion access into the end of the wrench. After tightening of a nut has been performed, removal of the wrench is easily performed by shifting the handle and head portion axially of the jaw member, and then moving the jaw member and head portion free.

While various modifications of the invention have been described, it should be obvious that other variations and modifications are possible. It is desired to cover all such modifications and variations as would be apparent to one skilled in the art.

It is claimed and desired to secure by Letters Patent:

1. An open-end ratchet wrench comprising:

a handle portion joined to a crescent-shaped head portion which head portion has opposed arms terminating in spaced apart ends extending incompletely about an opening which extends axially in the head portion, a jaw member mounted within said opening and rotatable relative to said head portion, said jaw member having an internal axially extending chamber opening to ends of the jaw member defined by internal wall surfaces adapted nonrotatably to receive a nut, releasable indent-detent means interposed between the head portion and jaw member accommodating rotation of the jaw member without release of the indent-detent means, and limited axial displacement of the jaw member from the opening in the head portion with partial release of the indent-detent means, and ratchet means interposed between the head portion and jaw member for imparting rotary movement of the head portion to the jaw member with the head portion rotated in one direction only, said ratchet means comprising an annular row of teeth presented by and projecting axially of the jaw member and a cooperating annular row of teeth presented by and projecting axially of the head portion at one end thereof engaging the teeth of the jaw member with the head portion rotated in said one direction, said rows of teeth moving to a disengaged position with limited axial displacement of the jaw member and partial release of the indent-detent means to permit rotation of the head portion freely of the jaw member with rotation of the head portion in a direction opposite to said one direction.

2. The wrench of claim 1, wherein, the ratchet means further comprises another annular row of teeth presented by and projecting axially of the head portion at the opposite end thereof, said jaw member being removable from the head portion with full axial displacement of the jaw member from the opening in the head portion, and remounting of said jaw member in said opening with turning over of the jaw member being effective to place said other annular row of teeth in engagement with the annular row of teeth presented by and projecting axially of the jaw member.

3. The wrench of claim 1, wherein the releasable indent-detent means comprises an annular groove formed in the periphery of the jaw member, and multiple spring-biased detents mounted in said head portion and projecting radially inwardly and releasably seating in said groove.

4. An open-end ratchet wrench comprising:

a handle portion joined to a crescent-shaped head portion which head portion has opposed arms terminating in spaced apart ends extending incompletely about an axially extending opening in the head portion, a jaw member mounted within said opening and rotatable relative to said head portion, said jaw member having an internal axially extending chamber opening to opposite ends of the jaw member defined by internal wall surfaces adapted nonrotatable to receive a nut, ratchet means interposed between the head portion and jaw member for imparting rotary motion of the head portion to the jaw member with the head portion rotated in one direction only, said ratchet means comprising an annular row of teeth projecting axially outwardly of one axial end of the head portion and another annular row of teeth projecting axially outwardly from the opposite axial end of the head portion and a third annular row of teeth projecting axially from the jaw member, the annular row of teeth of the jaw member being cooperable with either of the rows of teeth of the head portion to produce ratchet movement, and means detachably holding the jaw member from axial movement in said head portion, the jaw member on being displaced axially and on detachment being reversible to place a different annular row of teeth of the head portion in cooperative engagement with the teeth of the jaw member.

5. The wrench of claim 4, wherein the means detachably holding the jaw member from axial displacement comprises releasable indent-detent means.

6. The wrench of claim 5, wherein said indent-detent means comprises an annular groove formed in the periphery of the jaw member and spring-biased detent means mounted in the head portion facing radially inwardly an engaging said groove.

7. The wrench of claim 4, wherein adjacent teeth on the jaw member are separated by a gap, said gap being bonded by side abuttments surfaces presented by adjacent teeth and each tooth is capped by inclined surfaces that, progressing toward the sides of the tooth, slope into a gap between adjacent teeth.

8. An open-end ratchet wrench comprising:

a handle portion joined to a crescent-shaped head portion which head portion has opposed arms terminating in spaced apart ends extending incompletely about a cylindrical axially extending opening in the head portion, a jaw member mounted on said head portion including a sleeve portion and an annular flange portion joined to an end of the sleeve portion, said jaw member having a slot extending along the side thereof and having an internal axially extending chamber opening to opposite ends of the jaw member defined by internal wall surfaces adapted nonrotatably to receive a nut, said jaw member being mounted on said head portion with said flange portion fitting against an axial end of said head portion and the sleeve portion progressing from said flange portion extending into said opening from said axial end of the head portion, ratchet means including ratchet structure presented by said axial end of said head portion and ratchet structure presented by said flange portion operable to impart rotary movement of the head portion to the jaw member with the head portion rotated in one direction and permitting free rotation of the head portion relative to the jaw member with the head portion rotated in an opposite direction, said jaw member being removable from said head portion with shifting of the jaw member in a direction extending axially of its sleeve portion to remove said sleeve portion from said opening, said jaw member being returnable to a position mounted on said head portion with said flange portion positioned adjacent an axial end of said portion opposite said first-mentioned axial end and with said sleeve portion progressing from said flange portion extending into said opening from said opposite axial end of the head portion, and ratchet structure presented by said opposite axial end of said head portion cooperable with said ratchet structure presented by said flange portion to impart rotary movement of the head portion to the jaw member with the head portion rotated in one direction and permit free rotation of the head portion relative to the jaw member with the head portion rotated in an opposite direction.

* * * * *